US005396272A

United States Patent [19]

Takahashi et al.

[11] Patent Number: 5,396,272

[45] Date of Patent: Mar. 7, 1995

[54] DROPLET EJECTING DEVICE

[75] Inventors: Yoshikazu Takahashi, Kasugai; Masahiko Suzuki, Nagoya; Hiroto Sugahara, Aichi, all of Japan

[73] Assignee: Brother Kogyo Kabushiki Kaisha, Nagoya, Japan

[21] Appl. No.: 918,692

[22] Filed: Jul. 27, 1992

[30] Foreign Application Priority Data

Sep. 20, 1991 [JP] Japan ..... 3-241501

[51] Int. Cl.[6] ..... B41J 2/135

[52] U.S. Cl. ..... 347/47

[58] Field of Search ..... 346/140 R; B41J 2/045, B41J 2/14, 2/135, 3/04, 2/16; 347/44, 47, 68

[56] References Cited

U.S. PATENT DOCUMENTS

| | | | |
|---|---|---|---|
| 4,580,148 | 4/1986 | Domoto et al. | 346/140 R |
| 4,752,788 | 6/1988 | Yasuhara et al. | 346/140 R |
| 4,879,568 | 11/1989 | Bartky et al. | 346/140 R |
| 4,887,100 | 12/1989 | Michaelis et al. | 346/140 R |
| 4,940,996 | 7/1990 | Paton et al. | 346/140 R |
| 4,942,409 | 7/1990 | Paton et al. | 346/140 R |
| 4,973,981 | 11/1990 | Bartky et al. | 346/1.1 |
| 4,980,703 | 12/1990 | Sakurai | 346/140 R |
| 5,189,437 | 2/1993 | Michaelis et al. | 346/140 R X |
| 5,208,604 | 5/1993 | Watanabe et al. | 346/1.1 |

FOREIGN PATENT DOCUMENTS

| | | | |
|---|---|---|---|
| 0417673A | 3/1991 | European Pat. Off. . | |
| 60-92865 | 5/1985 | Japan . | |
| 0050150 | 3/1987 | Japan | 346/140 R |
| 63-64755 | 3/1988 | Japan . | |

*Primary Examiner*—Benjamin R. Fuller
*Assistant Examiner*—Alrick Bobb
*Attorney, Agent, or Firm*—Oliff & Berridge

[57] ABSTRACT

In a droplet ejecting device capable of being driven at a low voltage and having a simple structure with low manufacturing costs, the droplet ejecting device has multiple ejectors each for changing a pressure of ink held in an ink passage by the use of a pressure generator so as to eject the ink held in the ink passage through an ejection port. The ejection ports comprise a slit disposed across the multiple ink passages and the slit is formed into a tapered cross section thereby eliminating a required process for manufacturing the same number of tapered ejection ports as that of ink passages in the prior art. Therefore, it is possible to reduce the number of manufacturing processes, manufacturing costs, and a driving voltage.

4 Claims, 3 Drawing Sheets

DROPLET EJECTING DEVICE

BACKGROUND OF THE INVENTION

1. Field of the Invention

The invention relates to a droplet ejecting device and, more particularly, to the structure of an ejection port.

2. Description of Related Art

A bubble jet type ink jet printer using an electrothermal converting element as a pressure generator and a piezoelectric type ink jet printer using an electromechanical converting element as a pressure generator have been recently noticed for the reason of low noise in comparison with an impact type printer. For example, in the piezoelectric ink jet printer, the capacity of an ink passage is changed according to dimensional displacement of a piezoelectric actuator. Ink held in the ink passage is ejected through an ejection port when the capacity is decreased, while ink is introduced into the ink passage when the capacity is increased. This is called a drop-on-demand system. A multiplicity of ejectors operating as described above are arranged close to each other. Ink is ejected from the ejector located in a predetermined position whereby a desired character or image is formed.

In an array 1 constituting a conventional droplet ejecting device, the assembly perspective view being shown in FIG. 6, a cover 6 is joined to a grooved plate 2 having numerous ink passages 4 formed of grooves defined by side walls 7. A nozzle plate 8 having ejection ports 10 corresponding one to one to the ink passages 4 is bonded to the end surface of the assembly constituted of the grooved plate 2 and the cover 6. Accordingly, it is necessary to form the same number of ejection ports 10 as that of ink passages 4 thereby inducing the problem of many manufacturing processes. In addition, in order to eject ink at low energy, each of the ejection ports 10 ought to be formed into a tapered shape contributive to a decrease in ink passing resistance, with attendant problems of complicated manufacture and high manufacturing costs.

SUMMARY OF THE INVENTION

The invention has been accomplished in an attempt to solve the above problems observed in the prior art. It is an object of the invention to provide a droplet ejecting device capable of being driven at low energy, having ejection ports of a simple structure manufactured using few manufacturing processes and at low manufacturing costs.

In order to achieve the above object, the droplet ejecting device according to the invention has multiple ejectors each for changing a capacity of an ink passage by the use of a pressure generator so as to eject ink through an ejection port communicated with the ink passage. The ejection port comprises a slit disposed across the plural ink passages wherein the slit is formed to have a tapered cross section.

In the droplet ejecting device having the above structure according to the invention, ink held in the ink passage is ejected through the ejection port when the capacity of the ink passage corresponding to a predetermined one of the ejectors is decreased.

As is apparent from the above description, the droplet ejecting device according to the invention has a simple structure for the ejection ports, thereby reducing the number of manufacturing processes. As a result, it is possible to provide a droplet ejecting device capable of being driven at low energy and having a low manufacturing cost.

DETAILED DESCRIPTION OF THE PREFERRED EMBODIMENT

Figure 1:
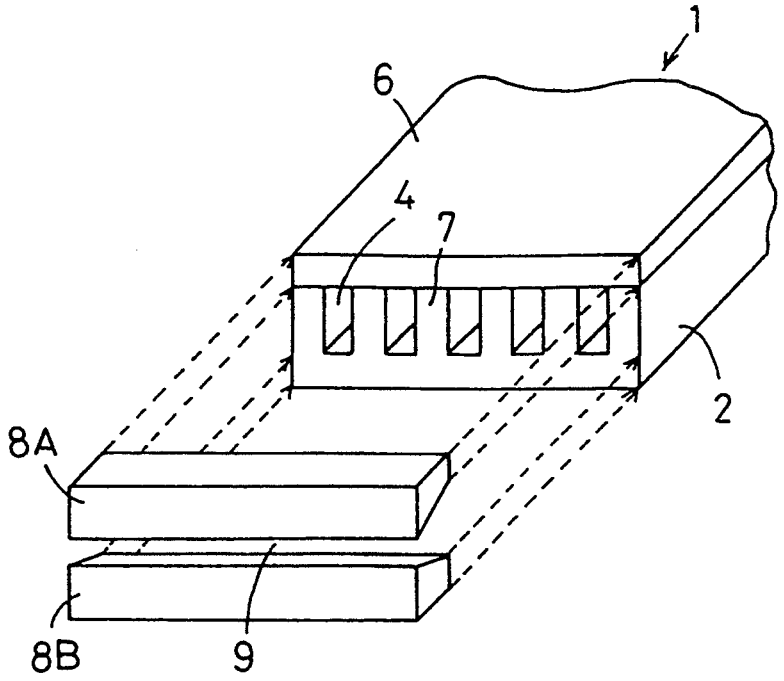
FIG. 1 is an perspective view of a part of an array constituting a droplet ejecting device.
Figure 2:
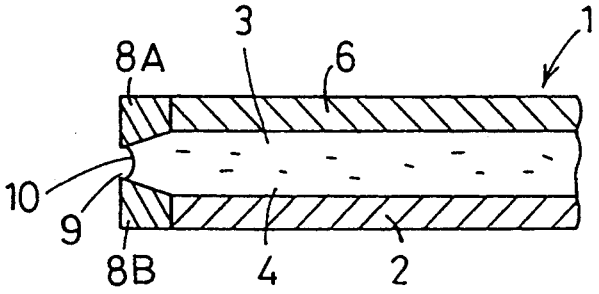
FIG. 2 is a side cross section of a part of the array constituting the droplet ejecting device.
Figure 3:
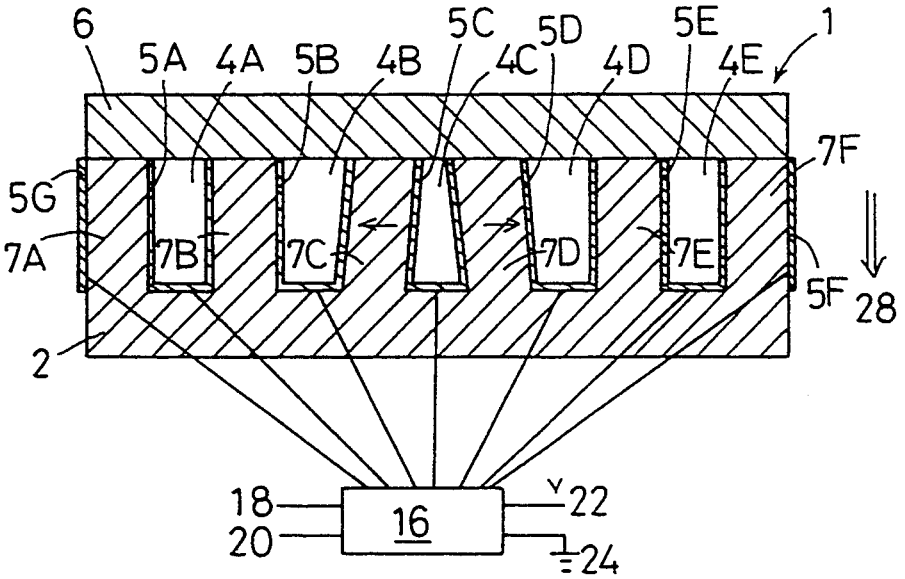
FIG. 3 is a front cross section of a part of the array constituting the droplet ejecting device.

Referring to FIGS. 1 through 3, a preferred embodiment according to the invention will be described in detail. Parts like or corresponding to those of the prior art are designated by the same reference numerals.

FIG. 1 shows an assembly perspective view of an array 1 of a droplet injecting device in a first embodiment. A grooved plate 2 having numerous parallel ink passages 4 defined by side walls 7 is covered with a cover 6 for closing the ink passages 4 and a pair of nozzle plates 8A, 8B are disposed in front of the ink passages 4. A slit 9 formed between the nozzle plates 8A, 8B and disposed across all the ink passages 4 is formed to have a tapered cross section. The taper decreases the size of slit 9 preceding from the face of grooved plate 2 to the outer face of nozzle plates 8A, 8B. As illustrated in FIG. 2, showing a side cross section of the array 1, the slit 9 constitutes ejection ports 10 of the ink passages 4 which are filled with ink 3.

As depicted in FIG. 3 showing a front cross section of the array 1, the grooved plate 2 is made of a piezoelectric ceramic material polarized in a polarizing direction 28. Driving electrodes 5A through 5E are attached to the inner surfaces of the ink passages 4, respectively, while driving electrodes 5F and 5G are attached to the outer side walls 7 of the grooved plate 2. All driving electrodes are connected to an electric circuit as shown. The electrodes 5A through 5G are independently connected to a driving LSI chip 16, which is connected to a clock line 18, a data line 20, a voltage line 22 and an earth line 24.

Non-adjacent ones of the ink passages 4A through 4E are divided into first and second groups. The first and second groups are driven in sequence by clock pulses sequentially supplied from the clock line 18. It is determined which one of the two groups consisting of the ink passages 4A through 4E is operated on the basis of multi-bit word data displayed on the data line 20. Then, a voltage V of the voltage line 22 is applied to the electrodes 5 disposed in the ink passages 4 of the group selected by the circuit of the driving LSI chip 16. With this application of voltage, the side walls 7A through 7F on both sides of the selected ones of the ink passages 4A through 4E are deformed by a piezoelectric effect. Consequently, all the ink passages 4A through 4E of each group becomes operable. At this time, the electrodes 5A through 5G of the inoperative ink passages 4A through 4E in the selected group and the electrodes 5A through 5G of the ink passages 4A through 4E in the non-selected group are grounded.

FIG. 3 shows an example where the ink passage 4C is selected on the basis of predetermined print data. The voltage V of the voltage line 22 is applied to the electrode 5C disposed inside the ink passage 4C, and the electrodes 5B and 5D are grounded. Electric fields perpendicular to the polarizing direction 28, i.e., in the directions indicated by the arrows in FIG. 3 are applied to the side walls 7C and 7D, respectively. Consequently, the side walls 7C and 7D are taperingly deformed toward the ink passage 4C interposed therebetween due to deformation caused by a piezoelectric thickness sliding effect. Accordingly, the capacity of the ink passage 4C is decreased so that the ink 3 held in the passage 4C is ejected through the corresponding injection port 10. Since the ejection port 10 is formed into a tapered shape, resistance generated in passing of the ink 3 through the ejection port 10 can be limited to a low level. Accordingly, the voltage required for ejecting droplets can be made low. When the application of the voltage is stopped so that the side walls 7C and 7D return to the original positions, ink 3 is resupplied from an ink supply port (not shown) according to the increase in capacity of the ink passage 4C at that time. If the other ink passage 4E, for example, is selected, the side walls 7E and 7F are deformed, and ink 3 held in the ink passage 4E is ejected.

Figure 6:
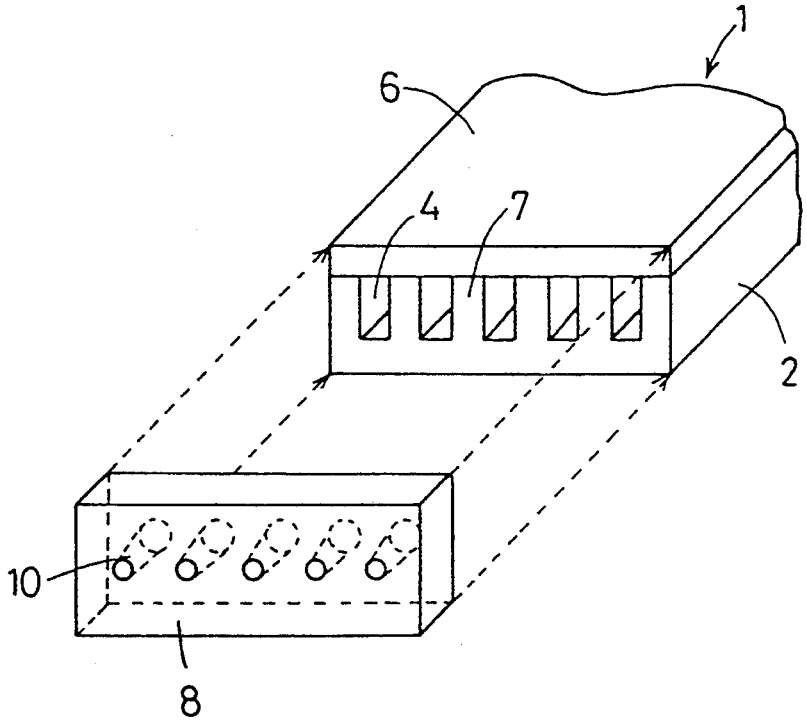
FIG.6 RELATED ART
FIG. 6 is a perspective view of a part of an array constituting a conventional droplet ejecting device.

In comparison with the case where the multiplicity of ejection ports 10 in the conventional droplet ejecting device shown in FIG. 6 are formed into a tapered shape, the ejection ports 10 in this embodiment can have the simpler constitution resulting in reduced manufacturing processes, thus reducing a manufacturing costs.

Figure 4:
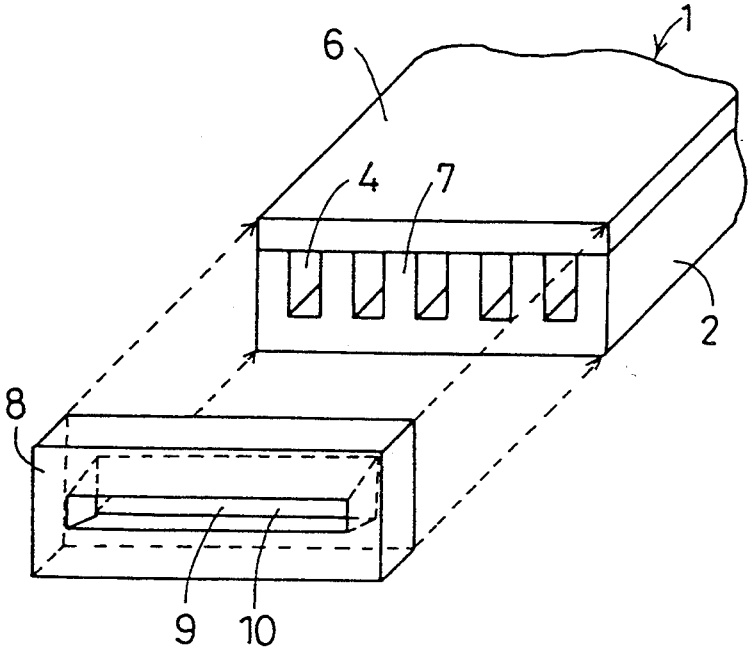
FIG. 4 is a perspective view of a part of an array constituting a droplet ejecting device in a second embodiment.
Figure 5:
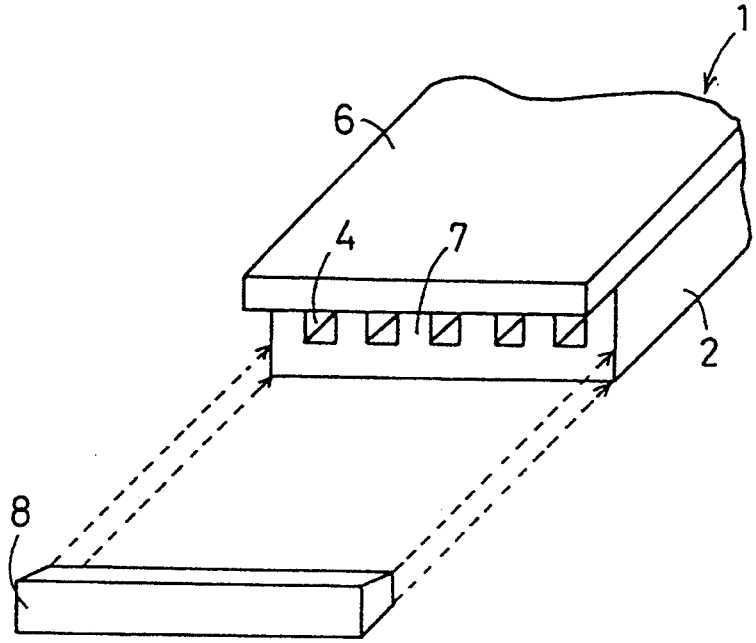
FIG. 5 is a perspective view of a part of an array constituting a droplet ejecting device in a third embodiment.

It is to be understood that the invention is not restricted to the particular embodiment described above and various modifications and alterations can be made thereto without departing from the scope of the invention. For example, as illustrated in FIG. 4, a nozzle plate 8 may be a one piece plate with a slit 9 having a tapered cross section formed therein or, as depicted in FIG. 5, a slit 9 may be formed as a combination of the cover 6 and a tapered nozzle plate 8.

What is claimed is:

1. An ink droplet ejecting device having multiple ejectors, comprising:

a base having a plurality of grooves each having a plurality of sides, said grooves forming the multiple ejectors;

a cover mounted to said base for enclosing a top of each of the multiple ejectors, said base further having a face; and two plates, a first of said plates being an extension of said cover and a second of said plates being attached to said face of said base, said plates defining a slit shaped ejection port therebetween, said slit shaped ejection port extending laterally across said face of said base, said slit shaped ejection port in combination with sides of said plurality of grooves defining a small ejection port associated with each one of said grooves, wherein said slit shaped ejection port decreases in size from a widest point closest to said face of said base to a narrowest point at an ejection face of said slit shaped ejection port; a surface of said second of said plates contacting said face of said base and being narrower than an outer surface of said second of said plates so as to provide the decreasing size of said slit shaped ejection port from said base to said outer surface.

2. An ink droplet ejecting device as claimed in claim 1, wherein the decreasing size of said ejection port is a tapering inwardly from the widest point closest to said face of said base to the narrowest point at said ejection face of said ejection port.

3. An ink droplet ejecting device, comprising:

a base containing a plurality of ink passages, each of said ink passages having a capacity which is changeable, said base further having a face;

a cover mounted to said base for enclosing said ink passages to form ink ejectors; and two plates, a first of said plates being an extension of said cover and a second of said plates being attached to said face of said base, said plates defining a slit shaped ejector port therebetween, said slit shaped ejector port extending laterally across said face of said base, wherein said slit shaped ejector port decreases in size from a widest point closest to said face of said base to a narrowest point at an ejector face of said slit shaped ejector port; a surface of said second of said plates contacting said face of said base and being narrower than an outer surface of said second of said plates so as to provide the decreasing size of said slit shaped ejector port from said base to said outer surface.

4. The ink droplet ejecting device as claimed in claim 3, wherein the decreasing size of said slit shaped ejector port is a tapering inwardly from a widest point closest to said face of said base and to the narrowest point at said ejection face of said slit shaped ejector port.

* * * * *